US008348532B2

(12) United States Patent
Takeda et al.

(10) Patent No.: US 8,348,532 B2
(45) Date of Patent: Jan. 8, 2013

(54) METHOD OF CONTROLLING TRANSPORT AMOUNT TRANSPORT DEVICE AND RECORDING APPARATUS

(75) Inventors: Kazuhisa Takeda, Nagano (JP); Hidetoshi Kodama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 82 days.

(21) Appl. No.: 12/945,940

(22) Filed: Nov. 15, 2010

(65) Prior Publication Data

US 2011/0056796 A1 Mar. 10, 2011

Related U.S. Application Data

(62) Division of application No. 11/497,276, filed on Aug. 2, 2006, now Pat. No. 7,857,535.

(30) Foreign Application Priority Data

Aug. 2, 2005 (JP) ..... 2005-223720
Jun. 29, 2006 (JP) ..... 2006-180146

(51) Int. Cl.
*B41J 13/02* (2006.01)
*B41J 13/08* (2006.01)

(52) U.S. Cl. ..... 400/636; 400/578; 271/3.14; 271/272

(58) Field of Classification Search ..... 400/578, 400/617, 634, 636, 637; 271/3.14, 272
See application file for complete search history.

(56) References Cited

U.S. PATENT DOCUMENTS

| | | | | |
|---|---|---|---|---|
| 6,378,858 | B1 * | 4/2002 | Suga | 271/10.01 |
| 6,519,049 | B1 | 2/2003 | Nagasaka | |
| 6,851,802 | B2 | 2/2005 | Sakakibara et al. | |
| 7,914,216 | B2 * | 3/2011 | Yasue et al. | 400/636 |
| 2006/0077242 | A1 | 4/2006 | Takeishi et al. | |
| 2008/0007586 | A1 | 1/2008 | Yoshida et al. | |

FOREIGN PATENT DOCUMENTS

| | | | |
|---|---|---|---|
| JP | 05-305747 | A | 11/1993 |
| JP | 08-072341 | A | 3/1996 |
| JP | 08-282027 | A | 10/1996 |
| JP | 2004-002019 | A | 1/2004 |
| JP | 2004123313 | | 4/2004 |

* cited by examiner

*Primary Examiner* — Daniel J Colilla
*Assistant Examiner* — Marissa Ferguson Samreth
(74) *Attorney, Agent, or Firm* — Sughrue Mion, PLLC

(57) ABSTRACT

A method of controlling transport amounts of a pair of first rollers and a pair of second rollers, the pair of first rollers operable to nip a medium so as to transport the medium in a transport direction, the pair of second rollers operable to nip the medium so as to transport the medium and disposed at a downstream side of the pair of first rollers in the transport direction, the medium on which a recording is performed by a recording head disposed between the pair of first rollers and the pair of second rollers, the method includes performing a first correction with respect to the transport amounts of the pair of first rollers and the pair of second rollers; and performing a second correction with respect to the transport amounts of at least the pair of first rollers, from a state in which length between a trailing end of the medium and a nip point of the medium at which the medium is nipped by the pair of first rollers is a predetermined length to a state in which the medium is released from being nipped by the pair of first rollers.

4 Claims, 13 Drawing Sheets

FIG. 5

| PASS | RAW DATA (A) | | DIFFERENCE FROM TRANSPORT LOGICAL VALUE (B) | | 17 PASS ACCUMULATIVE VALUE (C) | |
|---|---|---|---|---|---|---|
| | 1st DIGIT SIDE | 80th DIGIT SIDE | 1st DIGIT SIDE | 80th DIGIT SIDE | 1st DIGIT SIDE | 80th DIGIT SIDE |
| 1 | 1510.2 | 1512.4 | -6.7 | -4.5 | -12.8 | -6.8 |
| 2 | 1509.7 | 1509 | -7.2 | -7.9 | -22.6 | -14.7 |
| 3 | 1524.4 | 1527.8 | 7.5 | 10.9 | -2.0 | 5.7 |
| 4 | 1515.6 | 1518.2 | -1.3 | 1.3 | -8.6 | -5.6 |
| 5 | 1503.4 | 1504 | -13.5 | -12.9 | -26.5 | -25.6 |
| 6 | 1530.7 | 1528.3 | 13.8 | 11.4 | -7.0 | -6.0 |
| 7 | 1514.7 | 1514.5 | -2.2 | -2.4 | -10.7 | -6.5 |
| 8 | 1508.8 | 1508.1 | -8.1 | -8.8 | -9.5 | -3.7 |
| 9 | 1523.3 | 1524.7 | 6.4 | 7.8 | 4.7 | 8.8 |
| 10 | 1515.4 | 1513.9 | -1.5 | -3.0 | 1.3 | 4.8 |
| 11 | 1518 | 1517.1 | 1.1 | 0.2 | -7.5 | -4.4 |
| 12 | 1512.5 | 1512.4 | -4.4 | -4.5 | -5.3 | -1.7 |
| 13 | 1525.7 | 1526.6 | 8.8 | 9.7 | -0.7 | 1.8 |
| 14 | 1506.6 | 1504.1 | -10.3 | -12.8 | -12.5 | -11.8 |
| 15 | 1510.9 | 1512.4 | -6.0 | -4.5 | -0.5 | 2.4 |
| 16 | 1523 | 1522.8 | 6.1 | 5.9 | 6.6 | 6.5 |
| 17 | 1522.4 | 1525 | 5.5 | 8.1 | -8.6 | -9.3 |
| 18 | 1500.4 | 1504.5 | -16.5 | -12.4 | -6.6 | -11.8 |
| 19 | 1530.3 | 1529.4 | 13.4 | 12.5 | 9.9 | 2.5 |
| 20 | 1517.8 | 1516.5 | 0.9 | -0.4 | -0.1 | -5.7 |
| 21 | 1497.7 | 1498.2 | -19.2 | -18.7 | 8.6 | 1.8 |
| 22 | 1522.9 | 1523.6 | 6.0 | 6.7 | 22.0 | 14.5 |
| 23 | 1527 | 1527.8 | 10.1 | 10.9 | 17.4 | 13.2 |
| 24 | 1515.9 | 1517.3 | -1.0 | 0.4 | 7.8 | 1.8 |
| 25 | 1523 | 1520.6 | 6.1 | 3.7 | 12.6 | 5.6 |
| 26 | 1519.9 | 1520.7 | 3.0 | 3.8 | 2.0 | -4.7 |
| 27 | 1506.6 | 1504.7 | -10.3 | -12.2 | 8.1 | 0.2 |
| 28 | 1520.2 | 1519.8 | 3.3 | 2.9 | 9.4 | 2.4 |
| 29 | 1517.1 | 1515.9 | 0.2 | -1.0 | 8.9 | 1.7 |
| 30 | 1513.9 | 1513 | -3.0 | -3.9 | 7.4 | -3.9 |
| 31 | 1518.6 | 1518.3 | 1.7 | 1.4 | 9.7 | -2.8 |
| 32 | 1518 | 1516.5 | 1.1 | -0.4 | 12.3 | 0.8 |
| 33 | 1507.8 | 1507 | -9.1 | -9.9 | 11.8 | 3.2 |
| 34 | 1524.4 | 1522.5 | 7.5 | 5.6 | 20.4 | 9.8 |
| 35 | 1516.9 | 1518.8 | 0.0 | 1.9 | 13.2 | 4.3 |
| 36 | 1520.3 | 1521.2 | 3.4 | 4.3 | 9.8 | 2.6 |
| 37 | 1526.5 | 1524 | 9.6 | 7.1 | 14.8 | 4.0 |
| 38 | 1511.1 | 1510.9 | -5.8 | -6.0 | 11.8 | -0.1 |
| 39 | 1518.3 | 1522.3 | 1.4 | 5.4 | 6.8 | 6.7 |
| 40 | 1517.4 | 1516.4 | 0.5 | -0.5 | 17.7 | 8.6 |
| 41 | 1520.7 | 1521.1 | 3.8 | 4.2 | 10.0 | 3.8 |
| 42 | 1512.4 | 1510.3 | -4.5 | -6.6 | 5.6 | -1.7 |
| 43 | 1526 | 1525.6 | 9.1 | 8.7 | 16.1 | 8.1 |
| 44 | 1507.9 | 1506.9 | -9.0 | -10.0 | 7.1 | -3.6 |
| 45 | 1519.7 | 1519.1 | 2.8 | 2.2 | 6.7 | -2.4 |
| 46 | 1515.6 | 1510.3 | -1.3 | -6.6 | 17.1 | 8.2 |
| 47 | 1516.2 | 1514.1 | -0.7 | -2.8 | 10.8 | 8.1 |
| 48 | 1521.2 | 1521.9 | 4.3 | 5.0 | 16.6 | 8.1 |
| 49 | 1517.5 | 1518.9 | 0.6 | 2.0 | 8.0 | 1.4 |
| 50 | 1516.4 | 1513.6 | -0.5 | -3.3 | 12.8 | 3.4 |

FIG. 6

| PASS | RAW DATA (A) | | DIFFERENCE FROM TRANSPORT LOGICAL VALUE (B) | | 17 PASS ACCUMULATIVE VALUE (C) | |
|---|---|---|---|---|---|---|
| | 1st DIGIT SIDE | 80th DIGIT SIDE | 1st DIGIT SIDE | 80th DIGIT SIDE | 1st DIGIT SIDE | 80th DIGIT SIDE |
| 51 | 1517.2 | 1517 | 0.3 | 0.1 | -1.4 | -7.4 |
| 52 | 1513.5 | 1517.1 | -3.4 | 0.2 | 6.0 | 6.9 |
| 53 | 1525.3 | 1522.6 | 8.4 | 5.7 | 12.0 | 8.1 |
| 54 | 1523.5 | 1519.9 | 6.6 | 3.0 | 9.4 | 5.1 |
| 55 | 1506.1 | 1517.7 | -10.8 | 0.8 | -0.3 | 0.1 |
| 56 | 1529.2 | 1524.2 | 12.3 | 7.3 | 15.7 | 6.7 |
| 57 | 1509.7 | 1511.6 | -7.2 | -5.3 | 2.8 | -4.9 |
| 58 | 1516.3 | 1515.6 | -0.6 | -1.3 | 15.2 | 5.3 |
| 59 | 1522.9 | 1520.1 | 6.0 | 3.2 | 16.7 | 5.1 |
| 60 | 1517 | 1513.9 | 0.1 | -3.0 | 9.9 | 0.6 |
| 61 | 1507.5 | 1508.1 | -9.4 | -8.8 | 12.9 | 6.7 |
| 62 | 1530.1 | 1529.7 | 13.2 | 12.8 | 18.9 | 12.6 |
| 63 | 1509.3 | 1510.2 | -7.6 | -6.7 | 10.8 | 1.3 |
| 64 | 1522 | 1514.1 | 5.1 | -2.8 | 14.7 | 3.3 |
| 65 | 1512.6 | 1515.2 | -4.3 | -1.7 | 3.3 | 1.7 |
| 66 | 1522.3 | 1520.9 | 5.4 | 4.0 | 13.4 | 6.5 |
| 67 | 1502.2 | 1502.8 | -14.7 | -14.1 | 1.3 | -3.2 |
| 68 | 1524.6 | 1531.3 | 7.7 | 14.4 | 20.8 | 16.7 |
| 69 | 1519.5 | 1518.3 | 2.6 | 1.4 | 15.1 | 4.8 |
| 70 | 1522.7 | 1519.6 | 5.8 | 2.7 | 8.8 | -1.3 |
| 71 | 1513.8 | 1514.9 | -3.1 | -2.0 | 10.7 | 0.9 |
| 72 | 1522.1 | 1524.3 | 5.2 | 7.4 | 15.7 | 5.3 |
| 73 | 1516.3 | 1512.6 | -0.6 | -4.3 | 14.5 | 0.9 |
| 74 | 1522.1 | 1521.8 | 5.2 | 4.9 | 22.7 | 14.4 |
| 75 | 1517.8 | 1515.4 | 0.9 | -1.5 | 15.6 | 8.3 |
| 76 | 1516.1 | 1515.6 | -0.8 | -1.3 | 9.1 | 1.8 |
| 77 | 1520 | 1520 | 3.1 | 3.1 | 9.9 | 2.0 |
| 78 | 1513.5 | 1514 | -3.4 | -2.9 | 5.0 | -2.6 |
| 79 | 1522 | 1518.4 | 5.1 | 1.5 | 2.6 | -7.8 |
| 80 | 1513.2 | 1512.2 | -3.7 | -4.7 | 4.1 | -3.2 |
| 81 | 1510.6 | 1512.5 | -6.3 | -4.4 | 6.4 | 0.0 |
| 82 | 1522.7 | 1520 | 5.8 | 3.1 | 13.2 | 5.3 |
| 83 | 1510.2 | 1511.2 | -6.7 | -5.7 | 6.5 | 0.1 |
| 84 | 1521.7 | 1522.7 | 4.8 | 5.8 | 12.3 | 3.8 |
| 85 | 1518.9 | 1519.4 | 2.0 | 2.5 | 2.1 | -9.7 |
| 86 | 1513.2 | 1512.2 | -3.7 | -4.7 | 6.5 | -5.5 |
| 87 | 1524.6 | 1521.8 | 7.7 | 4.9 | 16.6 | 6.3 |
| 88 | 1518.8 | 1519.3 | 1.9 | 2.4 | 12.5 | 4.1 |
| 89 | 1520.9 | 1519.9 | 4.0 | 3.0 | -0.7 | -8.8 |
| 90 | 1524.5 | 1526.1 | 7.6 | 9.2 | 5.4 | -1.6 |
| 91 | 1515 | 1515.7 | -1.9 | -1.2 | -3.1 | -12.0 |
| 92 | 1511.3 | 1508.9 | -5.6 | -8.0 | -3.3 | -13.8 |
| 93 | 1516.9 | 1515.8 | 0.0 | -1.1 | 3.1 | -5.0 |
| 94 | 1515.1 | 1515.4 | -1.8 | -1.5 | 8.7 | 0.5 |
| 95 | 1511.1 | 1508.8 | -5.8 | -8.1 | 4.1 | -3.8 |
| 96 | 1523.5 | 1523 | 6.6 | 6.1 | 6.9 | 0.1 |
| 97 | 1515.5 | 1515.4 | -1.4 | -1.5 | 4.6 | -4.7 |
| 98 | 1517.4 | 1517.8 | 0.5 | 0.9 | -6.8 | -19.2 |
| 99 | 1516 | 1514.8 | -0.9 | -2.1 | 8.7 | -6.0 |
| 100 | 1516 | 1514.9 | -0.9 | -2.0 | 13.2 | -0.1 |

FIG. 7

| PASS | RAW DATA (A) | | DIFFERENCE FROM TRANSPORT LOGICAL VALUE (B) | | 17 PASS ACCUMULATIVE VALUE (C) | |
|---|---|---|---|---|---|---|
| | 1st DIGIT SIDE | 80th DIGIT SIDE | 1st DIGIT SIDE | 80th DIGIT SIDE | 1st DIGIT SIDE | 80th DIGIT SIDE |
| 101 | 1511.5 | 1509.2 | -5.4 | -7.7 | 6.8 | -2.9 |
| 102 | 1523.3 | 1523.6 | 6.4 | 6.7 | 13.9 | 5.5 |
| 103 | 1523.3 | 1524 | 6.4 | 7.1 | 13.2 | 3.1 |
| 104 | 1520.5 | 1519.6 | 3.6 | 2.7 | -4.4 | -14.1 |
| 105 | 1505.6 | 1506.4 | -11.3 | -10.5 | 6.2 | -4.4 |
| 106 | 1527 | 1527.1 | 10.1 | 10.2 | 14.2 | 5.2 |
| 107 | 1516 | 1515.7 | -0.9 | -1.2 | 4.8 | -5.3 |
| 108 | 1514.8 | 1513.9 | -2.1 | -3.0 | 7.4 | -1.7 |
| 109 | 1517.7 | 1517.7 | 0.8 | 0.8 | 6.7 | -0.6 |
| 110 | 1522.5 | 1521.3 | 5.6 | 4.4 | 0.7 | -9.9 |
| 111 | 1510.5 | 1511.1 | -6.4 | -5.8 | -0.7 | -13.8 |
| 112 | 1513.9 | 1512.7 | -3.0 | -4.2 | 7.4 | -9.9 |
| 113 | 1521.2 | 1518.2 | 4.3 | 1.3 | 12.3 | 2.9 |
| 114 | 1504.1 | 1500.9 | -12.8 | -16.0 | 7.2 | -4.3 |
| 115 | 1532.9 | 1531 | 16.0 | 14.1 | 12.4 | 4.7 |
| 116 | 1520.5 | 1520.7 | 3.6 | 3.8 | 0.4 | -7.2 |
| 117 | 1509.6 | 1512.1 | -7.3 | -4.8 | -5.8 | -15.4 |
| 118 | 1518.6 | 1517.6 | 1.7 | 0.7 | 10.4 | -0.8 |
| 119 | 1522.6 | 1521.2 | 5.7 | 4.3 | 7.5 | -1.5 |
| 120 | 1505.7 | 1506.8 | -11.2 | -10.1 | -6.4 | -15.3 |
| 121 | 1531.1 | 1529.3 | 14.2 | 12.4 | 10.0 | 2.6 |
| 122 | 1513.6 | 1516 | -3.3 | -0.9 | 2.7 | -0.9 |
| 123 | 1517.6 | 1516.6 | 0.7 | -0.3 | 2.7 | -0.7 |
| 124 | 1518.6 | 1519.3 | 1.7 | 2.4 | 11.7 | 4.4 |
| 125 | 1514.1 | 1515 | -2.8 | -1.9 | 15.0 | 2.1 |
| 126 | 1511.7 | 1508.4 | -5.2 | -8.5 | 11.0 | -1.7 |
| 127 | 1521.1 | 1517.4 | 4.2 | 0.5 | 22.5 | 11.6 |
| 128 | 1518.6 | 1515 | 1.7 | -1.9 | 22.0 | 14.3 |
| 129 | 1518.8 | 1525.5 | 1.9 | 8.6 | 18.2 | 11.8 |
| 130 | 1516.1 | 1511 | -0.8 | -5.9 | 22.2 | 9.7 |
| 131 | 1509.3 | 1509.9 | -7.6 | -7.0 | 25.5 | 16.8 |
| 132 | 1520.9 | 1519.1 | 4.0 | 2.2 | 24.9 | 18.3 |
| 133 | 1514.3 | 1512.5 | -2.6 | -4.4 | 32.8 | 26.7 |
| 134 | 1525.8 | 1526.7 | 8.9 | 9.8 | 35.0 | 30.8 |
| 135 | 1515.7 | 1516.9 | -1.2 | 0.0 | 25.0 | 22.9 |
| 136 | 1508.7 | 1507.4 | -8.2 | -9.5 | 34.8 | 30.7 |
| 137 | 1522.1 | 1524.7 | 5.2 | 7.8 | 50.4 | 47.8 |
| 138 | 1523.8 | 1525.8 | 6.9 | 8.9 | 36.8 | 31.8 |
| 139 | 1513.6 | 1516.2 | -3.3 | -0.7 | 44.2 | 37.2 |
| 140 | 1526.6 | 1521.7 | 9.7 | 4.8 | 48.7 | 41.0 |
| 141 | 1521.9 | 1517 | 5.0 | 0.1 | 38.4 | 36.3 |
| 142 | 1510.1 | 1511.2 | -6.8 | -5.7 | 40.0 | 43.7 |
| 143 | 1523.2 | 1521.7 | 6.3 | 4.8 | 43.4 | 45.8 |
| 144 | 1520.6 | 1520.1 | 3.7 | 3.2 | 36.3 | 45.5 |
| 145 | 1514.8 | 1512.5 | -2.1 | -4.4 | 39.9 | 40.3 |
| 146 | 1522.8 | 1523.4 | 5.9 | 6.5 | 34.8 | 42.9 |
| 147 | 1519.4 | 1518.1 | 2.5 | 1.2 | 28.0 | 33.9 |
| 148 | 1508.7 | 1511.4 | -8.2 | -5.5 | 28.7 | 35.2 |
| 149 | 1528.8 | 1527.5 | 11.9 | 10.6 | 45.2 | 52.8 |
| 150 | 1516.5 | 1516.6 | -0.4 | -0.3 | 41.1 | 44.1 |

FIG. 8

| PASS | RAW DATA (A) | | DIFFERENCE FROM TRANSPORT LOGICAL VALUE (B) | | 17 PASS ACCUMULATIVE VALUE (C) | |
|---|---|---|---|---|---|---|
| | 1st DIGIT SIDE | 80th DIGIT SIDE | 1st DIGIT SIDE | 80th DIGIT SIDE | 1st DIGIT SIDE | 80th DIGIT SIDE |
| 151 | 1515.8 | 1518.8 | -1.1 | 1.9 | 41.6 | 44.5 |
| 152 | 1525.5 | 1524.7 | 8.6 | 7.8 | 42.7 | 42.6 |
| 153 | 1524.3 | 1524.5 | 7.4 | 7.6 | 34.2 | 34.9 |
| 154 | 1508.5 | 1508.7 | -8.4 | -8.2 | 26.8 | 27.3 |
| 155 | 1531.2 | 1531.2 | 14.3 | 14.3 | 35.3 | 35.6 |
| 156 | 1518.1 | 1520 | 1.2 | 3.1 | 21.0 | 21.3 |
| 157 | 1516.3 | 1517 | -0.6 | 0.1 | 19.9 | 18.3 |
| 158 | 1523.5 | 1524.4 | 6.6 | 7.5 | 20.5 | 18.2 |
| 159 | 1513.5 | 1513.3 | -3.4 | -3.6 | 13.9 | 10.7 |
| 160 | 1516.1 | 1521.4 | -0.8 | 4.5 | 17.4 | 14.4 |
| 161 | 1524.2 | 1514.9 | 7.3 | -2.0 | 18.2 | 9.9 |
| 162 | 1509.7 | 1515.1 | -7.2 | -1.8 | 11.0 | 12.0 |
| 163 | 1516 | 1514.4 | -0.9 | -2.5 | 18.2 | 13.8 |
| 164 | 1520.1 | 1519.4 | 3.2 | 2.5 | 19.2 | 16.4 |
| 165 | 1525.2 | 1529 | 8.3 | 12.1 | 16.0 | 13.9 |
| 166 | 1524.7 | 1518.8 | 7.8 | 1.9 | 7.8 | 1.9 |
| 167 | 1510.2 | 1512.7 | | | | |
| 168 | 1527.6 | 1525 | | | | |
| 169 | 1512.5 | 1512.4 | | | | |
| 170 | 1543.9 | 1545.5 | | | | |
| 171 | 1512.5 | 1506.7 | | | | |
| 172 | 1532.8 | 1534.6 | | | | |
| 173 | 1518.6 | 1521.1 | | | | |
| 174 | 1520.3 | 1521.4 | | | | |
| 175 | 1519.3 | 1522 | | | | |
| 176 | 1517.9 | 1517 | | | | |
| 177 | 1508.6 | 1510.4 | | | | |
| 178 | 1517.3 | 1521.8 | | | | |
| 179 | 1512.7 | 1517.1 | | | | |
| 180 | 1516.8 | 1520.8 | | | | |
| 181 | 1511.4 | 1517.1 | | | | |
| 182 | 1506.8 | 1515.4 | | | | |
| 183 | 1513.3 | 1520.1 | | | | |
| 184 | 1505.4 | 1511.4 | | | | |
| 185 | 1512.4 | 1515.6 | | | | |
| 186 | 1520.6 | 1518.6 | | | | |
| 187 | 1508.2 | 1515.4 | | | | |
| 188 | 1513.3 | 1519.6 | | | | |
| 189 | 1521.4 | 1524.1 | | | | |
| 190 | 1516.4 | 1519.5 | | | | |
| 191 | 1518.8 | 1517.1 | | | | |
| 192 | 1539.5 | 1542.2 | | | | |
| 193 | | | | | | |

FIG. 10

| PASS | RAW DATA (A) | | DIFFERENCE FROM TRANSPORT LOGICAL VALUE (B) | | 17 PASS ACCUMULATIVE VALUE (C) | |
|---|---|---|---|---|---|---|
| | 1st DIGIT SIDE | 80th DIGIT SIDE | 1st DIGIT SIDE | 80th DIGIT SIDE | 1st DIGIT SIDE | 80th DIGIT SIDE |
| 1 | 1523 | 1522.5 | 6.1 | 5.6 | 0.1 | 4.2 |
| 2 | 1506.2 | 1503.2 | -10.7 | -13.7 | -5.7 | -0.5 |
| 3 | 1519.4 | 1517.9 | 2.5 | 1.0 | 2.2 | 8.1 |
| 4 | 1511.8 | 1513 | -5.1 | -3.9 | 4.1 | 10.1 |
| 5 | 1504.9 | 1507 | -12.0 | -9.9 | -4.0 | -0.9 |
| 6 | 1533.7 | 1531.4 | 16.8 | 14.5 | 9.6 | 5.6 |
| 7 | 1518.3 | 1518.2 | 1.4 | 1.3 | -0.6 | -1.3 |
| 8 | 1509.9 | 1508.2 | -7.0 | -8.7 | -4.6 | -2.0 |
| 9 | 1522.9 | 1523.3 | 6.0 | 6.4 | 6.4 | 12.8 |
| 10 | 1516.4 | 1517.6 | -0.5 | 0.7 | -0.9 | 7.3 |
| 11 | 1513 | 1515.7 | -3.9 | -1.2 | 3.1 | 9.3 |
| 12 | 1518.4 | 1521.9 | 1.5 | 5.0 | 9.1 | 13.9 |
| 13 | 1524 | 1524.6 | 7.1 | 7.7 | 10.9 | 12.1 |
| 14 | 1514.6 | 1516.5 | -2.3 | -0.4 | 1.2 | 3.6 |
| 15 | 1519.1 | 1519.8 | 2.2 | 2.9 | 5.6 | 6.1 |
| 16 | 1514.3 | 1512.6 | -2.6 | -4.3 | -3.5 | -3.3 |
| 17 | 1518.3 | 1518.9 | 1.4 | 2.0 | 0.0 | 0.2 |
| 18 | 1517.2 | 1517.8 | 0.3 | 0.9 | 4.1 | 1.3 |
| 19 | 1514.1 | 1511.8 | -2.8 | -5.1 | 8.4 | 1.2 |
| 20 | 1521.3 | 1519.9 | 4.4 | 3.0 | 3.2 | -2.4 |
| 21 | 1503.7 | 1502 | -13.2 | -14.9 | 10.1 | 7.2 |
| 22 | 1518.5 | 1513.5 | 1.6 | -3.4 | 14.4 | 12.1 |
| 23 | 1523.5 | 1524.5 | 6.6 | 7.6 | 8.6 | 12.1 |
| 24 | 1514.3 | 1517.5 | -2.6 | 0.6 | 12.0 | 14.9 |
| 25 | 1520.9 | 1523 | 4.0 | 6.1 | 10.8 | 11.8 |
| 26 | 1515.6 | 1517.8 | -1.3 | 0.9 | 7.4 | 7.1 |
| 27 | 1520.4 | 1519.6 | 3.5 | 2.7 | 8.7 | 5.7 |
| 28 | 1519 | 1520.3 | 2.1 | 3.4 | 5.7 | 2.8 |
| 29 | 1520.2 | 1520.1 | 3.3 | 3.2 | 1.6 | -1.5 |
| 30 | 1514.3 | 1516.1 | -2.6 | -0.8 | 9.0 | 4.9 |
| 31 | 1519 | 1519 | 2.1 | 2.1 | 12.4 | 6.4 |
| 32 | 1510 | 1510.4 | -6.9 | -6.5 | 12.7 | 5.2 |
| 33 | 1517.8 | 1516.1 | 0.9 | -0.8 | 22.8 | 14.1 |
| 34 | 1522.4 | 1520 | 5.5 | 3.1 | 25.4 | 19.0 |
| 35 | 1521.5 | 1517.7 | 4.6 | 0.8 | 18.4 | 11.8 |
| 36 | 1508.9 | 1508.2 | -8.0 | -8.7 | 10.5 | 6.5 |
| 37 | 1528.2 | 1529.5 | 11.3 | 12.6 | 20.1 | 15.7 |
| 38 | 1508 | 1506.9 | -8.9 | -10.0 | 12.0 | 5.8 |
| 39 | 1512.7 | 1513.5 | -4.2 | -3.4 | 12.8 | 8.1 |
| 40 | 1526.9 | 1527.3 | 10.0 | 10.4 | 23.5 | 23.8 |
| 41 | 1513.1 | 1514.4 | -3.8 | -2.5 | 6.6 | 1.9 |
| 42 | 1517.5 | 1518.3 | 0.6 | 1.4 | 7.3 | 1.3 |
| 43 | 1516.9 | 1516.4 | 0.0 | -0.5 | 14.5 | 8.0 |
| 44 | 1517.4 | 1516.7 | 0.5 | -0.2 | 16.9 | 10.6 |
| 45 | 1514.9 | 1516 | -2.0 | -0.9 | 15.8 | 8.7 |
| 46 | 1527.6 | 1526.5 | 10.7 | 9.6 | 20.8 | 18.3 |
| 47 | 1517.7 | 1517.6 | 0.8 | 0.7 | 14.6 | 14.1 |
| 48 | 1519.3 | 1517.8 | 2.4 | 0.9 | 7.9 | 8.7 |
| 49 | 1520.1 | 1519.3 | 3.2 | 2.4 | 14.9 | 12.5 |
| 50 | 1520.4 | 1521 | 3.5 | 4.1 | 17.0 | 15.0 |

FIG. 11

| PASS | RAW DATA (A) | | DIFFERENCE FROM TRANSPORT LOGICAL VALUE (B) | | 17 PASS ACCUMULATIVE VALUE (C) | |
|---|---|---|---|---|---|---|
| | 1st DIGIT SIDE | 80th DIGIT SIDE | 1st DIGIT SIDE | 80th DIGIT SIDE | 1st DIGIT SIDE | 80th DIGIT SIDE |
| 51 | 1515.4 | 1512.8 | -1.5 | -4.1 | 9.6 | 2.2 |
| 52 | 1513.6 | 1512.4 | -3.3 | -4.5 | 17.2 | 16.3 |
| 53 | 1518.5 | 1517.4 | 1.6 | 0.5 | 9.9 | 14.1 |
| 54 | 1520.1 | 1519.6 | 3.2 | 2.7 | 1.7 | 4.0 |
| 55 | 1508.8 | 1509.2 | -8.1 | -7.7 | 9.1 | 7.3 |
| 56 | 1523.4 | 1529.2 | 6.5 | 12.3 | 14.6 | 12.8 |
| 57 | 1510 | 1505.4 | -6.9 | -11.5 | 11.1 | 1.3 |
| 58 | 1513.8 | 1513.8 | -3.1 | -3.1 | 17.1 | 10.5 |
| 59 | 1524.7 | 1525 | 7.8 | 8.1 | 19.4 | 11.6 |
| 60 | 1519.3 | 1519 | 2.4 | 2.1 | 13.7 | 6.8 |
| 61 | 1516.3 | 1514.8 | -0.6 | -2.1 | 16.9 | 10.5 |
| 62 | 1519.9 | 1525.6 | 3.0 | 8.7 | 20.6 | 16.3 |
| 63 | 1521.4 | 1522.3 | 4.5 | 5.4 | 17.4 | 7.5 |
| 64 | 1511 | 1512.2 | -5.9 | -4.7 | 18.9 | 9.7 |
| 65 | 1526.3 | 1521.6 | 9.4 | 4.7 | 19.0 | 9.0 |
| 66 | 1522.2 | 1521.8 | 5.3 | 4.9 | 16.3 | 10.8 |
| 67 | 1513 | 1508.2 | -3.9 | -8.7 | 8.9 | 2.7 |
| 68 | 1523 | 1526.9 | 6.1 | 10.0 | 13.0 | 11.1 |
| 69 | 1506.3 | 1510.2 | -10.6 | -6.7 | 10.6 | 2.4 |
| 70 | 1510.3 | 1507.3 | -6.6 | -9.6 | 12.9 | 0.6 |
| 71 | 1527.5 | 1522.9 | 10.6 | 6.0 | 24.0 | 11.1 |
| 72 | 1514.3 | 1514.7 | -2.6 | -2.2 | 14.9 | 5.3 |
| 73 | 1519.9 | 1517.7 | 3.0 | 0.8 | 13.5 | 4.2 |
| 74 | 1516 | 1514.6 | -0.9 | -2.3 | 20.2 | 11.7 |
| 75 | 1516.1 | 1514.9 | -0.8 | -2.0 | 16.4 | 8.3 |
| 76 | 1519 | 1520.2 | 2.1 | 3.3 | 17.8 | 12.2 |
| 77 | 1522.5 | 1522.7 | 5.6 | 5.8 | 15.6 | 10.3 |
| 78 | 1520 | 1520.6 | 3.1 | 3.7 | 14.6 | 9.4 |
| 79 | 1516.7 | 1516.8 | -0.2 | -0.1 | 10.0 | 5.4 |
| 80 | 1522.9 | 1524.5 | 6.0 | 7.6 | 16.5 | 11.1 |
| 81 | 1511.1 | 1511.5 | -5.8 | -5.4 | 6.7 | 0.2 |
| 82 | 1523.6 | 1523.4 | 6.7 | 6.5 | 5.5 | -0.6 |
| 83 | 1514.8 | 1513.7 | -2.1 | -3.2 | 5.1 | -3.1 |
| 84 | 1517.1 | 1516.6 | 0.2 | -0.3 | 7.7 | -0.9 |
| 85 | 1520.6 | 1518.2 | 3.7 | 1.3 | 6.6 | -3.5 |
| 86 | 1508.6 | 1508.4 | -8.3 | -8.5 | 10.8 | 2.0 |
| 87 | 1521.4 | 1517.8 | 4.5 | 0.9 | 17.7 | 6.6 |
| 88 | 1518.4 | 1517.1 | 1.5 | 0.2 | 12.8 | 2.5 |
| 89 | 1512.9 | 1513.6 | -4.0 | -3.3 | 9.0 | -0.9 |
| 90 | 1526.6 | 1525.2 | 9.7 | 8.3 | 12.1 | 1.3 |
| 91 | 1512.2 | 1511.2 | -4.7 | -5.7 | 1.1 | -8.5 |
| 92 | 1517.5 | 1518.8 | 0.6 | 1.9 | 6.2 | -2.7 |
| 93 | 1516.8 | 1518.3 | -0.1 | 1.4 | 8.1 | -0.8 |
| 94 | 1521.5 | 1521.8 | 4.6 | 4.9 | 5.3 | -6.3 |
| 95 | 1515.4 | 1516.6 | -1.5 | -0.3 | 7.5 | -4.0 |
| 96 | 1523.2 | 1522.5 | 6.3 | 5.6 | 4.9 | -7.0 |
| 97 | 1513.1 | 1513.6 | -3.8 | -3.3 | 3.0 | -9.0 |
| 98 | 1509.9 | 1510.7 | -7.0 | -6.2 | 8.0 | -4.3 |
| 99 | 1523.2 | 1520.9 | 6.3 | 4.0 | 17.7 | 5.0 |
| 100 | 1517.4 | 1515.9 | 0.5 | -1.0 | 16.4 | 3.0 |

FIG. 12

| PASS | RAW DATA (A) | | DIFFERENCE FROM TRANSPORT LOGICAL VALUE (B) | | 17 PASS ACCUMULATIVE VALUE (C) | |
|---|---|---|---|---|---|---|
| | 1st DIGIT SIDE | 80th DIGIT SIDE | 1st DIGIT SIDE | 80th DIGIT SIDE | 1st DIGIT SIDE | 80th DIGIT SIDE |
| 101 | 1516 | 1514 | -0.9 | -2.9 | 11.5 | -0.7 |
| 102 | 1524.8 | 1523.7 | 7.9 | 6.8 | 16.9 | 3.6 |
| 103 | 1515.5 | 1513 | -1.4 | -3.9 | 7.4 | -6.2 |
| 104 | 1516.5 | 1513.7 | -0.4 | -3.2 | -2.6 | -13.4 |
| 105 | 1514.6 | 1513.7 | -2.3 | -3.2 | 4.3 | -2.9 |
| 106 | 1516 | 1515.8 | -0.9 | -1.1 | 11.0 | 4.0 |
| 107 | 1515.6 | 1515.4 | -1.3 | -1.5 | 6.0 | -0.9 |
| 108 | 1517.3 | 1517 | 0.4 | 0.1 | 6.6 | -0.6 |
| 109 | 1519.4 | 1520.7 | 2.5 | 3.8 | 6.8 | -0.5 |
| 110 | 1514 | 1512.8 | -2.9 | -4.1 | -2.8 | -11.6 |
| 111 | 1523.7 | 1524.1 | 6.8 | 7.2 | 11.0 | 3.6 |
| 112 | 1512.8 | 1513.6 | -4.1 | -3.3 | 7.1 | -3.4 |
| 113 | 1521.3 | 1520.5 | 4.4 | 3.6 | 9.9 | 3.8 |
| 114 | 1518.1 | 1518.3 | 1.2 | 1.4 | 17.5 | 7.3 |
| 115 | 1519.6 | 1520 | 2.7 | 3.1 | 23.8 | 6.7 |
| 116 | 1521.9 | 1518.9 | 5.0 | 2.0 | 12.8 | 3.9 |
| 117 | 1512.5 | 1512.2 | -4.4 | -4.7 | 15.9 | 6.1 |
| 118 | 1521.4 | 1518.3 | 4.5 | 1.4 | 18.9 | 9.0 |
| 119 | 1515.3 | 1513.9 | -1.6 | -3.0 | 10.5 | 3.2 |
| 120 | 1505.5 | 1505.8 | -11.4 | -11.1 | 9.6 | 3.6 |
| 121 | 1523.4 | 1524.2 | 6.5 | 7.3 | 21.0 | 12.5 |
| 122 | 1521.3 | 1520.6 | 4.4 | 3.7 | 13.3 | 3.9 |
| 123 | 1511 | 1510.9 | -5.9 | -6.0 | -0.3 | -8.8 |
| 124 | 1516.2 | 1515.7 | -0.7 | -1.2 | 13.7 | 2.7 |
| 125 | 1517.5 | 1517.1 | 0.6 | 0.2 | 12.0 | -1.1 |
| 126 | 1509.8 | 1509.6 | -7.1 | -7.3 | 10.6 | -3.5 |
| 127 | 1527.8 | 1528 | 10.9 | 11.1 | 16.2 | 1.0 |
| 128 | 1519.8 | 1517.1 | 2.9 | 0.2 | 17.2 | 0.6 |
| 129 | 1515.6 | 1520.8 | -1.3 | 3.9 | 11.7 | -3.2 |
| 130 | 1528.9 | 1524 | 12.0 | 7.1 | 18.6 | -2.2 |
| 131 | 1524.4 | 1517.7 | 7.5 | 0.8 | 10.6 | -4.6 |
| 132 | 1508.6 | 1517.2 | -8.3 | 0.3 | 1.0 | -4.8 |
| 133 | 1525 | 1521.1 | 8.1 | 4.2 | 15.2 | 2.0 |
| 134 | 1515.5 | 1515.1 | -1.4 | -1.8 | 12.0 | 1.5 |
| 135 | 1513 | 1512.5 | -3.9 | -4.4 | 1.6 | -8.0 |
| 136 | 1514.4 | 1514.3 | -2.5 | -2.6 | 14.6 | 4.5 |
| 137 | 1516.9 | 1514.7 | 0.0 | -2.2 | 14.2 | 6.9 |
| 138 | 1515.7 | 1515.6 | -1.2 | -1.3 | 10.4 | 4.8 |
| 139 | 1507.7 | 1507.9 | -9.2 | -9.0 | 17.0 | 10.9 |
| 140 | 1525 | 1522.4 | 8.1 | 5.5 | 27.0 | 17.7 |
| 141 | 1514.5 | 1511.9 | -2.4 | -5.0 | 19.9 | 13.2 |
| 142 | 1516.1 | 1514.7 | -0.8 | -2.2 | 25.2 | 18.5 |
| 143 | 1515.4 | 1514.1 | -1.5 | -2.8 | 26.9 | 24.2 |
| 144 | 1528.8 | 1527.6 | 11.9 | 10.7 | 28.5 | 28.1 |
| 145 | 1514.3 | 1513.3 | -2.6 | -3.6 | 27.7 | 29.1 |
| 146 | 1522.5 | 1521.8 | 5.6 | 4.9 | 35.9 | 30.5 |
| 147 | 1520.9 | 1521.6 | 4.0 | 4.7 | 25.7 | 33.3 |
| 148 | 1514.8 | 1517.5 | -2.1 | 0.6 | 24.4 | 22.2 |
| 149 | 1522.8 | 1524 | 5.9 | 7.1 | 21.8 | 27.3 |
| 150 | 1521.8 | 1520.6 | 4.9 | 3.7 | 13.2 | 21.3 |

FIG. 13

| PASS | RAW DATA (A) | | DIFFERENCE FROM TRANSPORT LOGICAL VALUE (B) | | 17 PASS ACCUMULATIVE VALUE (C) | |
|---|---|---|---|---|---|---|
| | 1st DIGIT SIDE | 80th DIGIT SIDE | 1st DIGIT SIDE | 80th DIGIT SIDE | 1st DIGIT SIDE | 80th DIGIT SIDE |
| 151 | 1505.1 | 1505.6 | -11.8 | -11.3 | 8.3 | 17.7 |
| 152 | 1526 | 1525 | 9.1 | 8.1 | 20.2 | 29.0 |
| 153 | 1514 | 1516.7 | -2.9 | -0.2 | 11.1 | 21.0 |
| 154 | 1513.1 | 1512.6 | -3.8 | -4.3 | 14.1 | 21.2 |
| 155 | 1522.3 | 1521.7 | 5.4 | 4.8 | 17.9 | 25.6 |
| 156 | 1517.7 | 1514.7 | 0.8 | -2.2 | 12.6 | 20.8 |
| 157 | 1517.9 | 1517.9 | 1.0 | 1.0 | 11.8 | 23.1 |
| 158 | 1519.8 | 1517.2 | 2.9 | 0.3 | 10.8 | 22.1 |
| 159 | 1517.8 | 1520.4 | 0.9 | 3.5 | 8.0 | 21.8 |
| 160 | 1511.4 | 1518 | 0.0 | 1.1 | 7.1 | 18.4 |
| 161 | 1528 | 1528.6 | 11.1 | 11.7 | 7.1 | 17.3 |
| 162 | 1522.5 | 1514.7 | 5.6 | -2.2 | -3.9 | 5.7 |
| 163 | 1512.3 | 1524.6 | -4.6 | 7.7 | -9.5 | 7.9 |
| 164 | 1519.6 | 1510.5 | 2.7 | -6.4 | -4.8 | 0.3 |
| 165 | 1512.2 | 1522.6 | -4.7 | 5.7 | -7.5 | 6.7 |
| 166 | 1514.2 | 1518 | -2.7 | 1.1 | -2.7 | 1.1 |
| 167 | 1523.8 | 1519.4 | | | 0.0 | 0.0 |
| 168 | 1519.3 | 1516.8 | | | | |
| 169 | 1521.3 | 1518.3 | | | | |
| 170 | 1532.5 | 1531.3 | | | | |
| 171 | 1512.6 | 1504.5 | | | | |
| 172 | 1526.5 | 1534.2 | | | | |
| 173 | 1508.6 | 1517.8 | | | | |
| 174 | 1511.3 | 1515.8 | | | | |
| 175 | 1506.8 | 1517.1 | | | | |
| 176 | 1510.6 | 1510.5 | | | | |
| 177 | 1510 | 1515.3 | | | | |
| 178 | 1519.7 | 1517 | | | | |
| 179 | 1504.6 | 1511.6 | | | | |
| 180 | 1515.9 | 1517.6 | | | | |
| 181 | 1523.8 | 1528.2 | | | | |
| 182 | 1516.4 | 1516.3 | | | | |
| 183 | 1521.4 | 1521.9 | | | | |
| 184 | 1514.2 | 1515.5 | | | | |
| 185 | 1516.1 | 1516.6 | | | | |
| 186 | 1514 | 1519.5 | | | | |
| 187 | 1515.2 | 1516.4 | | | | |
| 188 | 1507.3 | 1515.4 | | | | |
| 189 | 1518.4 | 1522.4 | | | | |
| 190 | 1506.1 | 1519.1 | | | | |
| 191 | 1509.7 | 1511.8 | | | | |
| 192 | 1534.2 | 1539.3 | | | | |
| 193 | 1507.8 | 1506.6 | | | | |

METHOD OF CONTROLLING TRANSPORT AMOUNT TRANSPORT DEVICE AND RECORDING APPARATUS

This is a divisional of application Ser. No. 11/497,276 filed Aug. 2, 2006. The entire disclosure of application Ser. No. 11/497,276 is incorporated herein by reference in its entirety.

BACKGROUND OF THE INVENTION

The present invention relates to a method of controlling transport amounts of recording mediums, in which the recording mediums are being transported in a state in which the recording mediums are nipped between a pair of transport rollers and a pair of ejecting rollers, the pair of transport rollers transporting the recording mediums to the side of a recording head from a feed portion in which the recording mediums are laminated, the pair of ejecting rollers ejecting the recording mediums on which recording is performed by a recording head, a transport device, a recording apparatus having the transport device, and a liquid ejecting apparatus having the transport device.

Examples of a liquid ejecting apparatus include recording apparatus, such as an inkjet recording apparatus that ejects ink from a recording head serving as a liquid ejecting head to recording mediums, such as recoded paper, and performs recording on the recording mediums, a copy machine, a facsimile, and the like, and apparatuses that eject liquid corresponding to a specific use other than the ink onto ejected members corresponding to the recording mediums from a liquid ejecting head corresponding to the above-mentioned recording head and adhere the liquid to the ejected members. Further, examples of the liquid ejecting head include, in addition to the above-mentioned recording head, a colored member ejecting head that is used for manufacturing a color filter of a liquid crystal display, an electrode member (conductive paste) ejecting head that is used for forming electrodes of an organic EL display or a field emission display (FED), a living-body organic matter ejecting head that is used for manufacturing a biochip, a sample ejecting head that ejects a sample as a precise pipette, and the like.

As an example of the inkjet recording apparatus or the liquid ejecting apparatus, there is provided an inkjet printer. The inkjet printer includes a feed portion that feeds laminated recording mediums to a downstream-side transport path, a transport portion that transports the fed recording mediums to a recording portion, the recording portion that performs recording on the recording mediums, and an ejecting portion that ejects the recording mediums on which recording is performed. Among them, the transport portion has a pair of transport rollers that transport the recording mediums from the feed portion to the recording portion at the downstream side of the recording portion. Further, the recording portion has a recording head that ejects ink onto the recording mediums. Furthermore, the ejecting portion has a pair of ejecting rollers that eject the recording mediums at the downstream side of the recording portion. Each of the pair of transport rollers and the pair of ejecting rollers has a driving roller and a follower roller. The driving roller of each of the pair of transport rollers and the pair of ejecting rollers is rotatably driven by a common or separate motor. A rotational amount of the driving motor is controlled by a control unit, such that the recording mediums can be transported to the recording portion with a desired transport amount.

However, if kinds of the recording mediums are different from one another, the recording mediums are different from one another in the thickness, material, and weight of the recording medium. As a result, the friction coefficient between each of the driven transport roller and the driven ejecting roller (hereinafter, referred to as rollers) and the recording medium vary. Accordingly, slippage may occur between each of the rollers and the recording mediums per a kind of each of the recording mediums. If the slippage occurs between each of the rollers and the recording mediums, even though each of the roller is driven so as to rotate by a predetermined amount, the recording mediums are not transported as much as a target transport amount due to the slippage. Thereby, recording quality may be lowered. In particular, in an inkjet printer in which in recent years, image quality is exceedingly improved and photo image quality is achieved, paper transport accuracy of order of several micrometers is required. If the paper transport accuracy of order of several micrometers is not satisfied, streaks, that is, a so-called 'banding phenomenon' may occur in the recorded photograph. Therefore, the paper feeding accuracy is lowered, thereby notably affecting the recording result.

In this case, the 'banding phenomenon' refers to a phenomenon that, if printing and paper (recording medium) transport are continuously performed by a recording head and nozzles for printing of one row in order to perform printing of one row, clogging or an empty space occurs between subsequent printing rows due to the variation in the paper transport accuracy or the variation at locations of the recording head and the nozzles. Accordingly, the printing quality is lowered in not only monochrome printing but also color printing.

Accordingly, in order to resolve the above-mentioned problems, a raster-type recording apparatus is disclosed in JP-A-5-305747 or JP-A-8-72341. The raster-type recording apparatus measures an actual printing length R' (printing result) with respect to a predetermined printing length R (target value). In addition, since a value of a correction coefficient is calculated from the lengths R and R', it is possible to correct the transport amount in the actual printing operation by using the correction coefficient.

Further, generally, structures of the transport roller and the ejecting roller, such as materials, are different from each other. Therefore, the transport error when the recording medium is transported by the transport roller, and the transport error when the recording medium is transported by the ejecting roller are different from each other. The structure obtained by considering these points corresponds to a structure of a recording apparatus that is disclosed in JP-A-2004-123313. In JP-A-2004-123313, in the recording apparatus disclosed having a structure in which a plurality of pairs of rollers are provided and the combination of the roller pairs transporting the recording mediums varies, the transport amount of the recording medium can be appropriately corrected.

However, it is not possible to prevent the 'banding' phenomenon from occurring by only the above-mentioned correction. For example, until the recording medium is released from a nipping state between the transport roller pair after the trailing end of the recording medium passes through the feed portion, that is, the trailing end is completely passed through, with respect to the variation of the banding phenomenon occurring due to the friction between the trailing end of the recording medium and the transport path, or the variation of the rolling area (contact area) of the recording medium with respect to the transport roller due to the phenomenon that the trailing end of the recording medium automatically descends and the recording medium deforms, that is, the variation of a rolling angle, the consideration is not sufficiently made. For this reason, according to a kind of the paper (thick paper having high rigidity), until the trailing end is completely passed through, the transport amount of the recording medium may vary. As a result, the banding phenomenon may occur.

In this case, the 'passing through the feed portion' means that the recording medium passes through the region nipped between the feed roller of the feed portion and the transport path.

SUMMARY

It is therefore an object of the invention to provide a method of controlling transport amount, a transport device and a recording apparatus in which it is possible to remove an error of a transport amount of a recording medium occurring according to a kind of each of the recording mediums, until a part of the recording medium which disposed at an upstream side of the pair of transport rollers in a transport direction completely passes through the pair of transport rollers.

In order to achieve the object, according to the invention, there is provided a method of controlling transport amounts of a pair of first rollers and a pair of second rollers, the pair of first rollers operable to nip a medium so as to transport the medium in a transport direction, the pair of second rollers operable to nip the medium so as to transport the medium and disposed at a downstream side of the pair of first rollers in the transport direction, the medium on which a recording is performed by a recording head disposed between the pair of first rollers and the pair of second rollers, the method comprising:

performing a first correction with respect to the transport amounts of the pair of first rollers and the pair of second rollers; and performing a second correction with respect to the transport amounts of at least the pair of first rollers, from a state in which length between a trailing end of the medium and a nip point of the medium at which the medium is nipped by the pair of first rollers is a predetermined length to a state in which the medium is released from being nipped by the pair of first rollers.

In this case, the 'predetermined length' refer to size of the region where strong back tension occurring due to the friction between the medium and a transport path decreases, at the upstream side in the transport direction of the medium nipped by the pair of first rollers. That is, the 'predetermined length' refers to a size of the trailing end portion of the medium remaining on the upstream side of the pair of first rollers when the back tension is decreased. Moreover, the 'predetermined length' is determined by the kind of the medium, the shape of the transport path, and the angle difference between the transport path and the transport direction defined by the pair of first rollers, and it is not uniformly determined.

In order to achieve the object, according to the invention, there is also provided a method of controlling transport amounts of a pair of first rollers and a pair of second rollers, the pair of first rollers operable to nip a medium so as to transport the medium in a transport direction, the pair of second rollers operable to nip the medium so as to transport the medium and disposed at a downstream side of the pair of first rollers in the transport direction, the medium on which a recording is performed by a recording head disposed between the pair of first rollers and the pair of second rollers, the method comprising:

performing a first correction with respect to the transport amounts of the pair of first rollers and the pair of second rollers; and performing a second correction with respect to the transport amounts of at least the pair of first rollers, from a time when a contact area at which the medium is held into contact with one of the pair of first rollers starts to vary to a time when the medium is released from being nipped by the pair of first rollers.

In order to achieve the object, according to the invention, there is provided a transport device, comprising:

a pair of first rollers, operable to nip a medium so as to transport the medium in a transport direction;

a pair of second rollers, operable nip the medium so as to transport the medium, and disposed at a downstream side of the pair of first rollers in the transport direction;

a first controller, operable to perform a first correction with respect to transport amounts of the pair of first rollers and the pair of second rollers; and a second controller, operable to perform a second correction with respect to the transport amounts of at least the pair of first rollers, from a state in which length between a trailing end of the medium and a nip point of the medium at which the medium is nipped by the pair of first rollers is a predetermined length to a state in which the medium is released from being nipped by the pair of first rollers.

A recording apparatus incorporating the transport device may include a recording device, disposed between the pair of first rollers and the pair of second rollers and operable to record information on the medium.

The recording apparatus may further include a transport path on which the medium is transported, disposed at an upstream side of the pair of first rollers in the transport direction, and having a shape deforming the transported medium.

The recording apparatus may further include a transport path on which the medium is transported, disposed at an upstream side of the pair of first rollers in the transport direction, and including a first section and a second section connecting to the first section and arranged between the first section and the pair of first rollers. A slope of the first section may be greater than a slope of the second section.

A liquid ejecting apparatus incorporating the transport device may include a liquid ejecting device, disposed between the pair of first rollers and the pair of second rollers and operable to eject liquid toward the medium.

BRIEF DESCRIPTION OF THE DRAWINGS

FIG. 5 is a diagram illustrating data of a transport error before correction is performed in the second embodiment.

FIG. 6 is a diagram illustrating data of a transport error before correction is performed in the second embodiment.

FIG. 7 is a diagram illustrating data of a transport error before correction is performed in the second embodiment.

FIG. 8 is a diagram illustrating data of a transport error before correction is performed in the second embodiment.

FIG. 10 is a diagram illustrating data of a transport error after correction is performed in the second embodiment.

FIG. 11 is a diagram illustrating data of a transport error after correction is performed in the second embodiment.

FIG. 12 is a diagram illustrating data of a transport error after correction is performed in the second embodiment.

FIG. 13 is a diagram illustrating data of a transport error after correction is performed in the second embodiment.

DETAIL DESCRIPTION OF PREFERRED EMBODIMENTS

First Embodiment

Hereinafter, the first embodiment of the invention will be described with reference to the accompanying drawings.

Figure 1:
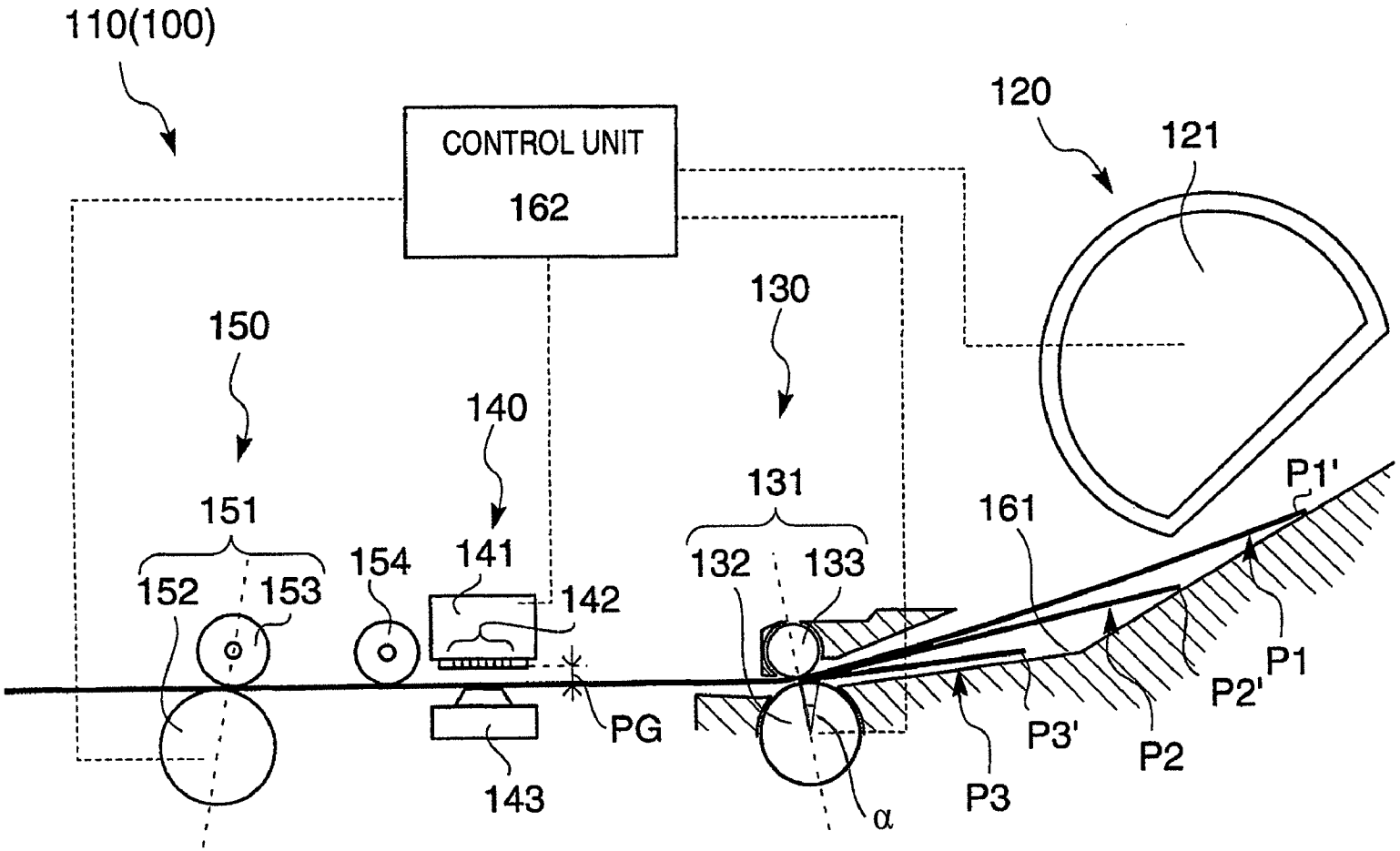
FIG. 1 is a lateral view schematically illustrating an inner structure of a recording apparatus according to an embodiment of the invention.

FIG. 1 is a lateral view schematically illustrating an inner structure of a recording apparatus according to an embodiment of the invention.

As shown in FIG. 1, a recording apparatus 100 includes a paper transport device 110 that transports paper P1 to P3. The paper transport device 110 has a feed portion 120 that feeds laminated paper (not shown) to a transport path 161, a transport portion 130 that transports the paper P1 to P3 fed by the feed portion 120 to a recording portion 140, the recording portion 140 that performs recording on the paper P1 to P3 transported by the transport portion 130, and an ejecting portion 150 that ejects the paper P1 to P3 recorded by the recording portion 140 from the recording apparatus 100.

The feed portion 120 has a feed roller 121 having a D shape in side view, and feeds the paper P1 to P3 to the transport path 161. The paper P1 to P3 that is fed to the transport path 161 is transported to the recording portion 140 located at the downstream side of the transport direction while being nipped between a pair of transport rollers 131 that is provided in the transport portion 130. The pair of transport rollers 131 have a transport driving roller 132 that is driven by a driving motor (not shown), and a transport follower roller 133 that is driven by the transport driving roller 132 so as to rotate. Further, the recording portion 140 has a platen 143 that supports the paper P1 to P3 transported by the transport portion 130 from a lower side, and a recording head 141 that is provided at a location opposite to the platen 143. Furthermore, in the recording head 141, a nozzle opening array 142 for ejecting ink is formed, and the recording head 141 can eject ink onto the paper P1 to P3 so as to perform the recording thereon. In this case, a predetermined gap, that is, a so-called platen gap or paper gap PG (hereinafter, referred to as platen gap) is provided between the recording head 141 and the platen 143.

In addition, the paper P1 to P3 on which recording is performed is ejected from the recording portion 140 while being nipped between a pair of ejecting rollers 151 that is provided in the ejecting portion 150. The pair of ejecting rollers 151 have an ejecting driving roller 152 that is driven by the driving motor (not shown), and an ejecting follower roller 153 that is driven by the ejecting driving roller 152 so as to rotate. Further, an axis of the transport roller pair 131 and an axis of the ejecting roller pair 151 are inclined so as to form an 'inverted V shape' in the drawing. The reason why they are inclined so as to form an inverted V shape is to prevent that the paper P1 to P3 opposite to the recording head 141 floats from the platen 143, and thus the gap between the paper P1 to P3 and the recording head 141, that is, the platen gap PG varies. An auxiliary roller 154 that is provided between the recording head 141 and the ejecting roller pair 151 can further prevent the paper P1 to P3 from floating.

Moreover, the paper P1 to P3 and the trailing ends P1' to P3' thereof shows an aspect in which the paper is transported.

Figure 2:
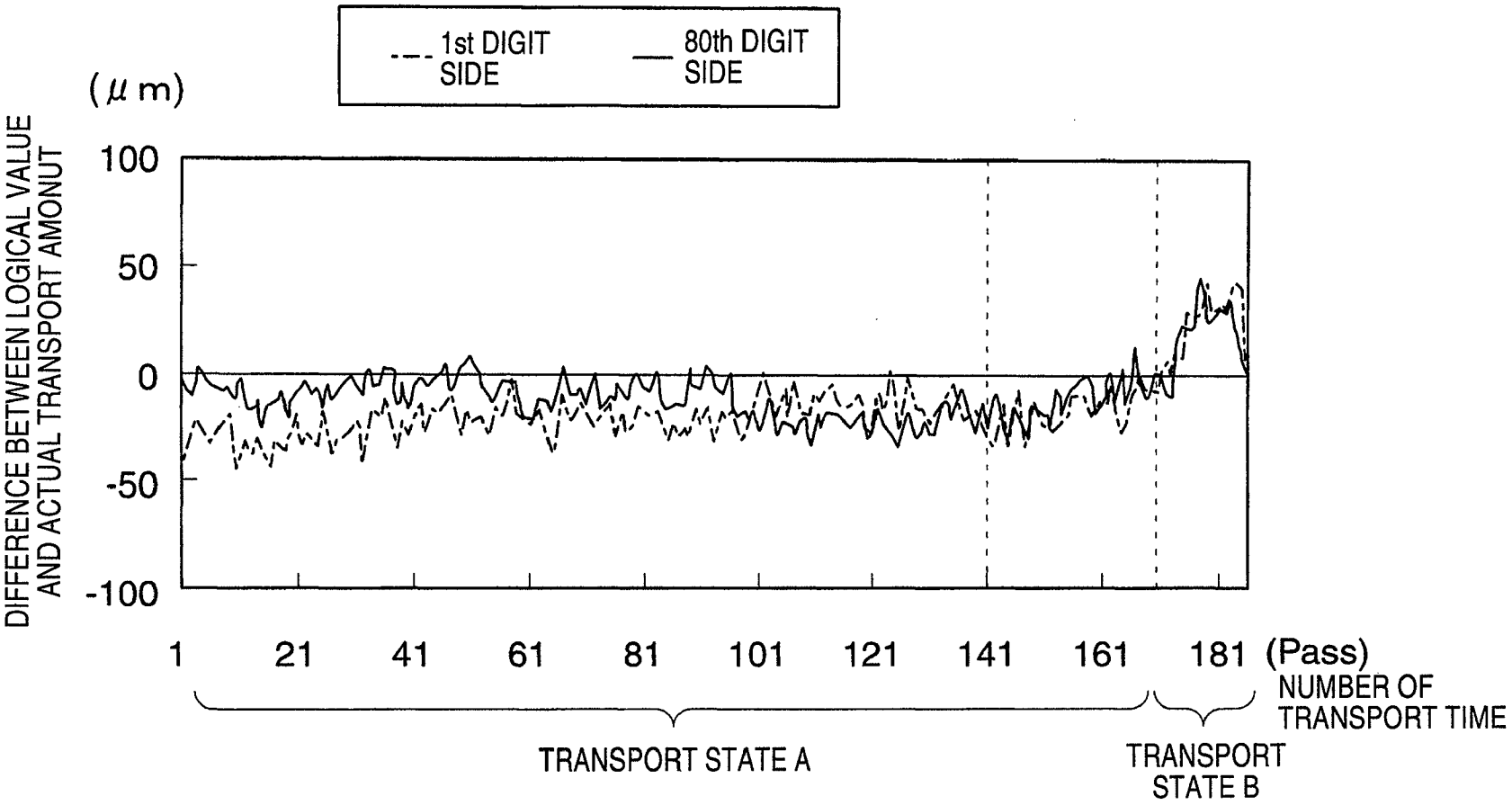
FIG. 2 is a graph illustrating a transport error when common paper is transported in the related art.
Figure 3:
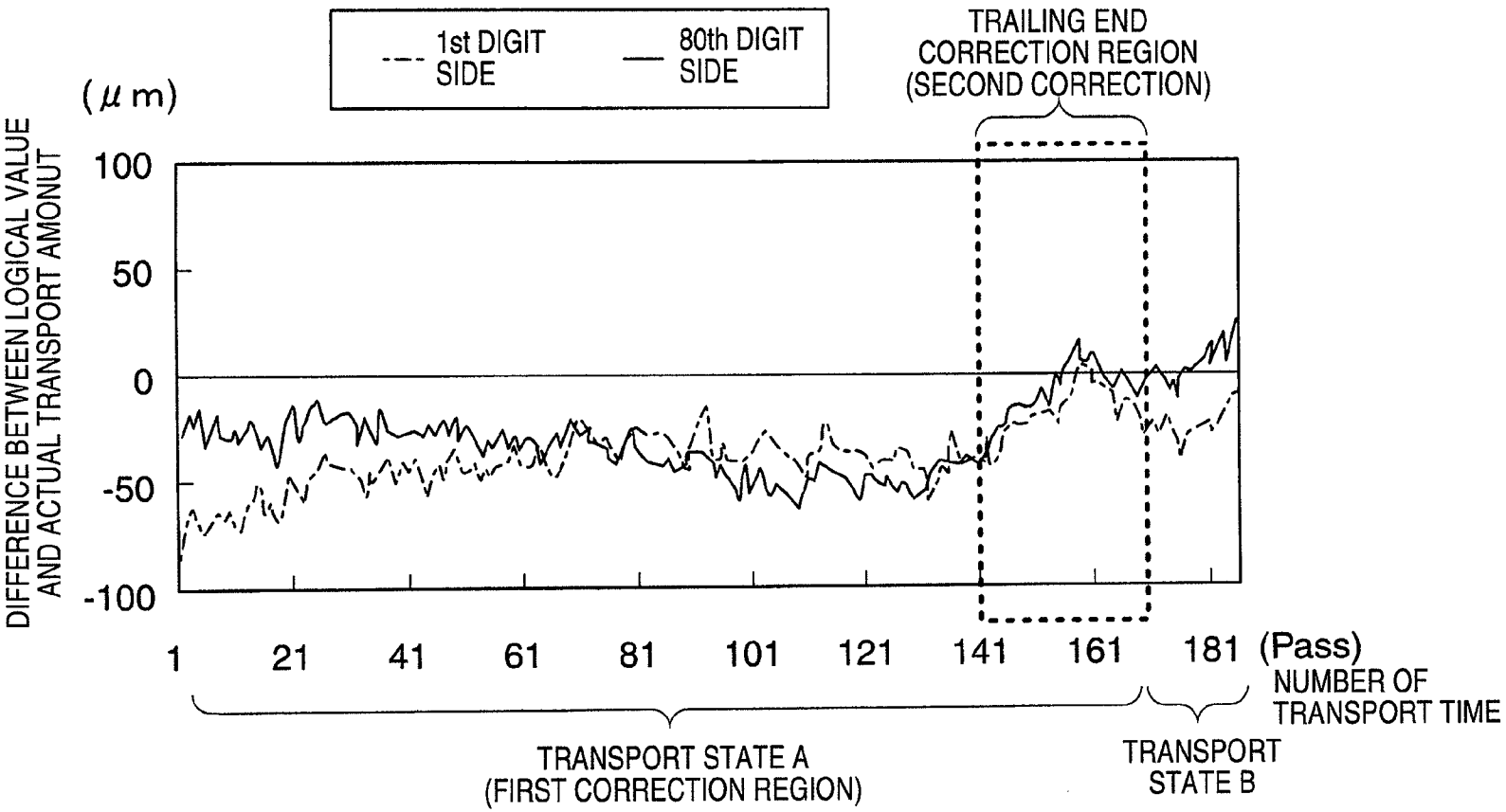
FIG. 3 is a graph illustrating a transport error when thick paper is transported in the related art.

FIG. 2 is a graph illustrating a transport error when the common paper is transported in the related art. FIG. 3 is a graph illustrating a transport error when the thick paper is transported in the related art. The graphs illustrated in FIGS. 2 and 3 show a state in which correction is not made with respect to a transport amount, when the paper is transported.

In FIGS. 2 and 3, a longitudinal axis of the graph indicates the difference between a logical value of the 'transport amount' by which the paper P1 to P3 is transported and an actual transport amount. Plus values mean that paper is transported by a transport amount greater than the logical value of the transport amount, and minus values mean that the paper is transported by a transport amount smaller than the logical value due to the slippage or back tension. Meanwhile, a horizontal axis indicates the number of times when the paper is transported from a leading end of the paper (the number of transport times, Pass number). A solid line of the graph indicates a transport amount of the paper at the 80th digit side, and a chained line indicates a transport amount of the paper at the first (1st) digit side. Here, the 80th digit side means a left side in the transport direction, and the first digit side means a right side in the transport direction.

In this case, the 'common paper' refers to paper that has the thickness of about 0.1 mm, and the 'thick paper' refers to paper that has the thickness of 0.2 mm or more.

In a transport state, the term 'transport' refers to one paper transport obtained in the transport operation, that is, one pass, and amount of the one paper transport is about 1.4 mm.

Further, 'the difference between the logical value and the actual transport amount' indicated by the longitudinal axis of the graph refers to the difference between the transport amount accumulated by 18 Pass (from 1 to 18, from 2 to 19, from 3 to 20, . . . ) and the logical transport amount, and a value 0 of the longitudinal axis indicates a logical transport amount. Further, the reason why the transport amount is accumulated is as follows. Since the difference between the logical value and the transport amount is very small, it is very difficult to confirm the difference between the logical value and the transport amount. Therefore, the transport amount is accumulated, and thus the difference with the logical value and the transport amount is notably shown.

Further, in the present embodiment, the length of P2 is about 40 mm.

In addition, the distance between the transport roller pair 131 and the nip point of the feed roller 121 is about 70 mm. Further, among the inclined surfaces of the transport path 161, the interface between a moderate inclined surface of the transport path 161 at the transport roller pair which the trailing end of the paper does not come into contact with and a steep inclined surface of the transport path 161 at the feed roller side which the trailing end of the paper comes into contact with is provided on the upstream side from the transport roller pair by about 30 mm. Further, the angle difference between the transport direction from the transport roller pair and the moderate inclined surface is about −5 degrees. In the meantime, the angle difference between the transport direction from the transport roller pair and the steep inclined surface is about 8 degrees.

Moreover, the distance from the transport roller pair to the nip point of the feed roller, and the configuration of the transport path, such as the shape and the angle of the transport path, are not limited to the above-mentioned embodiment.

As shown in FIG. 2, on the first digit side and the 80th digit side, the same level is maintained over 1 to 170 Pass on the horizontal axis, and each level varies from 171 Pass.

In this case, in 1 to 170 Pass on the horizontal axis, the paper is transported while being nipped between the transport roller pair 131 and the ejecting roller pair 151 shown in FIG. 1, and this state is referred as a transport state A. Meanwhile, from 171 Pass on the horizontal axis, the trailing ends P1' to P3' of paper pass through the transport roller pair 131, and they are transported (ejected) while being nipped between only the pair of the ejecting rollers 151. This state is referred as a transport state B. Further, 141 Pass on the horizontal axis shows a state in which the trailing ends P1' to P3' of paper pass through the feed roller 121 of the feed portion 120. Specifically, it shows the location P2' shown in FIG. 1. In addition, 171 Pass on the horizontal axis shows a state in which the trailing ends P1' to P3' of paper pass through the pair of transport rollers 131.

The reason why the level varies from 171 Pass on the horizontal axis is because the transport state varies. The specific reason is as follows. Generally, since the transport driving roller 132 and the ejecting driving roller 152 are formed of different materials from each other, the error of the transport amount when the paper is transported by only the transport roller pair 131 is different from the error of the transport amount when the paper is transported by only the ejecting roller pair 151. Accordingly, in the transport state A where the paper is transported by the transport roller pair 131 and the ejecting roller pair 151 and in the transport state B where the paper is transported by only the ejecting roller pair 151, the difference between the logical value and the actual transport amount, that is, the error levels are different from each other.

Moreover, in the transport state B rather than the transport state A, the level of the difference between the logical value and the actual transport amount is increased, but this depends on the material of the paper, the material of the transport driving roller 132, and the material of the ejecting driving roller 152. The level of the difference between the logical value and the actual transport amount in the transport state B is not necessarily higher than that in the transport state A. That is, the level of the difference between the logical value and the actual transport amount in the transport state B may be lower than that in the transport state A.

As shown in FIG. 3, at the first digit side and the 80th digit side, the same level is maintained up to the 1 to 140 Pass on the horizontal axis, and the level varies from 141 Pass in the same manner. In this case, in 1 to 50 Pass on the horizontal axis, the levels of the first digit side and the 80th digit side are slightly different from each other, but the difference between the levels of the first digit side and the 80th digit side is not considered herein. As described above, 141 Pass on the horizontal axis shows a state when the paper trailing end passes through the feed roller 121 of the feed portion 120. Specifically, it shows the location of P2' shown in FIG. 1.

FIG. 3 is a graph illustrating a state in which the thick paper is transported. Accordingly, when the paper is deformed or bent by the transport path 161, the trailing ends P2' to P3' come into contact with the transport path 161, which causes strong back tension to be generated. Although the back tension is generated in the common paper, the stronger back tension is generated in the thick paper, as compared with the common paper. In addition, when the trailing end moves from the trailing end P1 to the trailing end P3', the friction between the trailing end P3' and the transport path 161 is removed, which result in decreasing the back tension.

Specifically, in the state of the paper P1, since the upstream side is sufficiently long from the transport roller pair 131, the paper P1 is deformed by the transport path 161. That is, since the trailing end P1' is pushed down by the transport path 161, the friction occurs in the trailing end P1', which causes the back tension. In the case of the thick paper, the back tension is stronger than that in the case of the common paper.

In addition, the paper is transported to the location of the paper P2 by the transport roller pair 131. At this time, as described above, the axis of the transport roller pair is inclined inward in the drawing. Accordingly, at the location of the paper P2, the transport direction from the transport roller pair 131 and the direction of the paper P2 are on the same line. That is, the trailing end P2' comes into contact with the transport path 161 without being pushed down by the transport path 161, and the back tension is drastically reduced. As a result, since the back tension is decreased, the paper is reliably transported by the transport roller pair 131.

Then, the paper is transported up to the location of the paper P3 by the transport roller pair 131. At this time, since the trailing end P3' is away from the transport path 161, the back tension is not generated. That is, the intensity of the back tension varies drastically near the location of the paper P2.

Further, as the location of the trailing end varies from the trailing end P1' to the trailing end P3', a rolling angle (angle $\alpha$ in FIG. 1) of the paper to the transport driving roller 132 is increased. That is, since the rolling amount (rolling area, contact area) is increased, it becomes difficult for the slippage to be generated.

Specifically, when the paper is transported from the location of the paper P1 to the location of the paper P2 by the transport roller pair 131, the rolling angle between the paper and the transport driving roller 132 varies. At this time, since the transport driving roller 132 is provided on the lower side, the rolling angle is gradually increased.

In addition, the paper is transported up to the location of the paper P3 by the transport roller pair 131. At this time, in the paper of the upstream side of the transport direction from the transport roller pair, as described above, since the axis of the transport roller pair is inclined, the inclination of the paper P2 is maintained. However, the thick paper is heavier than the common paper, and the trailing end P3 automatically descends downward, as compared with the common paper. Therefore, the rolling angle of the paper to the transport driving roller 132 is increased. As a result, it is difficult for the slippage to be generated between the paper and the transport driving roller 132. Therefore, the paper can be reliably transported by the transport roller pair 131.

Accordingly, the level of 141 to 170 Pass on the horizontal axis become higher than the level of 1 to 140 Pass on the horizontal axis. That is, in the case of the thick paper, in 141 to 170 Pass on the horizontal axis, the phenomenon that rarely occurs in the common paper occurs. Therefore, even in the same transport state A, the level of the longitudinal axis varies by a large amount.

In the transport state B after 171 Pass on the horizontal axis, similar to the case of the common paper shown in FIG. 2, the level varies with respect to the transport state A.

Further, the reason why the level of 1 to 170 Pass of the common paper shown in FIG. 2 and the level of 1 to 140 Pass of the thick paper shown in FIG. 3 are different is because the material is different according to the paper kind, and the difference between the materials of the transport driving roller 132 and the ejecting driving roller 152, for example, the difference between the friction coefficients exist.

The paper transport device 110 performs the first correction that corrects the entire level of the 'difference between the logical value and the actual transport amount' indicated by the longitudinal axis of the graph according to the paper kind in the state in which the paper is transported by the transport roller pair 131 and the ejecting roller pair 151, that is, a transport state A. According to the specific correction method, whenever the paper of several Pass to several tens of Pass (1 Pass=about 1.4 mm) is transported, correction is performed by the control unit 162, in which one step (about 5.9 μm) that is a minimum unit (resolution) of an encoder provided in the transport driving roller or the like is added or subtracted, and the entire level of the longitudinal axis is made to approximate a value 0 of the longitudinal axis being a logical value.

As a result, the level of 1 to 140 Pass on the horizontal axis in FIG. 3 are raised, and thus it is possible to make the difference between the logical value and the actual transport amount indicated by the longitudinal axis approximate to 0. However, if only the level are raised, the values between 141 to 170 Pass on the horizontal axis may be shifted from the logical value of the longitudinal axis.

Accordingly, in addition to the first correction, in the transport state A, a second correction that corrects a partial level of the 'difference between the logical value and the actual transport amount' indicated by the longitudinal axis of the graph is performed according to a kind of paper until the trailing ends P1' to P3' of the paper pass through the pair of transport rollers 131 (141 to 170 Pass) after the passing through the feed portion 120. The specific characteristic of the second correction method is the same as that of the first correction method.

As a result, the level of 141 to 170 Pass on the horizontal axis in FIG. 3 are lowered, thereby making the difference between the actual transport amount and the logical value indicated by the longitudinal axis approximate to 0.

In the present embodiment, in a method of controlling a paper transport amount that is a method of controlling transport amounts of recording mediums, the paper P1 to P3 are transported in a state in which the paper P1 to P3 are nipped between a pair of transport rollers 131 and a pair of ejecting rollers 151, the pair of transport rollers 131 transport the paper to the side of a recording head 141 from a feed portion 120 in which the paper P1 to P3 are laminated, and the pair of ejecting rollers 151 eject the paper P1 to P3 on which recording is performed by the recording head 141. The method includes the steps of performing a first correction per a kind of each of the paper to correct a transport amount of each of the transport driving roller 132 and the ejecting driving roller 152, and performing a second correction according to a kind of each of the paper with respect to transport amounts of the transport driving roller 132 and the ejecting driving roller 152 from a state in which the lengths P1 to P3 of the paper at the upstream side in the transport direction from the transport roller pair 131 after starting the transport of the paper nipped between the transport roller pair 131 have 'predetermined sizes' (length from the transport roller pair 131 to the trailing end P2') to a state in which the paper is further transported and released from being nipped between the transport roller pair 131.

For example, the second correction can be performed according to a kind of each of the paper with respect to the transport amounts of the transport driving roller 132 and the ejecting driving roller 152 from a state in which the intensity of the back tension occurring when the trailing ends P1' to P3' of the paper come into contact with the transport path 161 varies to be small to a state in the trailing ends P1' to P3' are released from being nipped between the pair of transport rollers. The transport amounts of the paper in the regions (in FIGS. 3, 141 to 170 Pass on the horizontal axis) where the back tension varies to decrease are increased, as compared with the transport amounts in the regions (in FIGS. 3, 1 to 140 Pass on the horizontal axis) before the back tension varies. Since the increased transport amount is corrected by the second correction, the transport amount of the paper can be stabilized from a state in which the lengths P1 to P3 of the paper at the upstream side in the transport direction from the transport roller pair 131 after starting the transport of the paper nipped between the transport roller pair 131 have 'predetermined sizes' to a state in which the paper is further transported and released from being nipped between the transport roller pair 131. As a result, the 'banding phenomenon' can be prevented.

Further, in the present embodiment, the second correction may be performed according to a kind of each of the paper with respect to the transport amounts of the transport driving roller 132 and the ejecting driving roller 152 from the state in which when the upstream sides P1 to P3 of the transport direction of the paper nipped between the transport roller pair 131 by the transport roller pair 131 are transported by the transport roller pair 131, the rolling angle between the transport driving roller 132 and the paper P1 to P3 starts to vary to the state in which the paper is further transported and then released from being nipped between the transport roller pair 131. In this case, as the paper is transported from the location of the paper P1, since the rolling angle between the paper and the transport driving roller 132 varies, in order to make the starting timing of the second correction earlier, the start timing of the second correction may be set to start from about 131 Pass on the horizontal axis, in FIG. 3.

As a result, from the state in which the rolling angle between the paper P1 to P3 and the transport driving roller 132 start to vary to the state in which the paper is further transported and released from being nipped between the transport roller pair 131, it is possible to stabilize the transport amounts of the paper P1 to P3 by the transport driving roller 132 and the ejecting driving roller 152.

Furthermore, in the present embodiment, the second correction is effective in a case in which the transport path 161 transporting the paper P1 to P3 from the feed portion 120 to the transport roller pair 131 is formed so as to deform the paper P1 to P3 nipped between the transport roller pair 131 and nipped between the ejecting roller pair 151. Specifically, the transport path 161 has a 'V' shape. The transport path 161 has a moderate inclined surface at the side of the transport roller pair which the trailing end of the paper does not come into contact with, and a steep inclined surface at the side of the feed roller which the trailing end comes into contact with. That is, the transport path 161 is formed such that the frictional amount between the transport path and the trailing end of the paper varies.

In the present embodiment, the first correction is performed in the transport state A when the paper is transported by the transport roller path and the ejecting roller pair. However, it may be performed in the transport state in which the paper is transported by only one of the transport roller pair and the ejecting roller pair.

Further, in the present embodiment, the second correction is performed with respect to the transport amounts of the transport driving roller and the ejecting driving roller. However, since the variation of the transport amount results from the upstream due to the nip point of the transport roller pair, the second correction may be performed with respect to only the transport amount of the transport driving roller. Further, the second correction refers to correction added to the first correction. However, the first correction may be completed before the second correction is performed and the third correction (=first correction+second correction) may be independently performed.

Furthermore, the transport driving roller may be disposed on a lower side, but may also be disposed on an upper side. In addition, the transport path from the feed portion to the transport roller pair is constructed to progress downward, but it may be constructed to progress upward.

Second Embodiment

Next, the second embodiment will be described. In the second embodiment, the actual steps for performing correction will be described.

Figure 4:
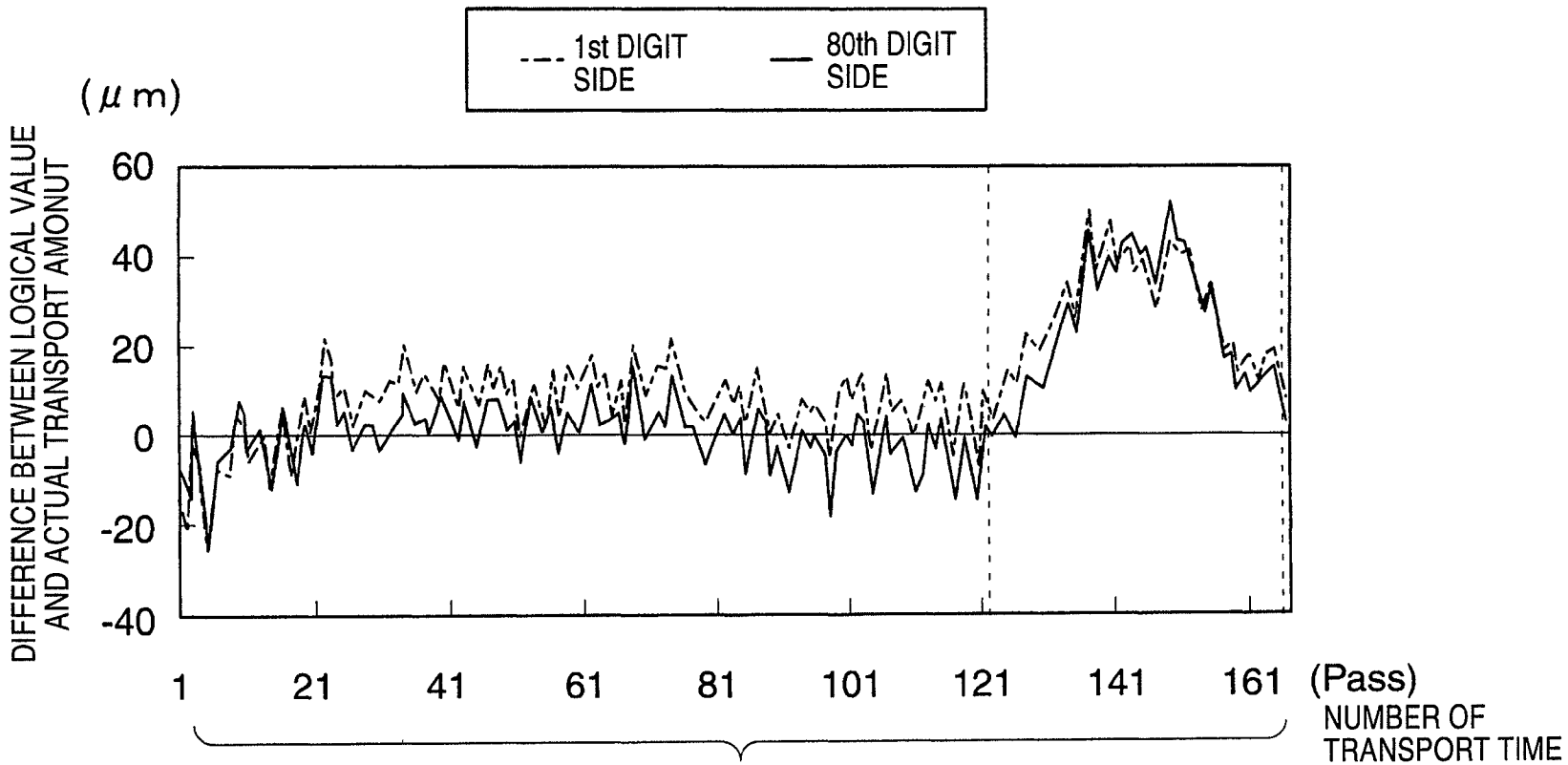
FIG. 4 is a graph illustrating a transport error before correction is performed in the second embodiment.

FIG. 4 shows a graph illustrating a transport error before the correction is performed in the second embodiment. The longitudinal axis indicates 17 Pass accumulative value of the difference between the logical value and the actual transport amount, and the horizontal axis indicates the number of transport times. FIGS. 5 to 8 show diagrams illustrating data of a transport error before the correction is performed. FIG. 5 shows a divided data from 1 Pass to 50 Pass, FIG. 6 shows a divided data from 51 Pass to 100 Pass, FIG. 7 shows a divided data from 101 Pass to 150 Pass and FIG. 8 shows a divided data from 151 Pass to 192 Pass.

The steps are as follows.

1. Capture pitch data (raw data) (unit: μm) that is a paper transport amount in a state in which correction is not performed (refer to (A), the second line and the third line from left side in FIGS. 5 to 8).

2. Convert to the difference from the transport logical value (refer to (B), the fourth line and the fifth line from left side in FIGS. 5 to 8).

3. Accumulate by 17 Pass in order to obtain correction amounts per inch (refer to (C), the sixth line and the seventh line from left side in FIGS. 5 to 8).

4. Determine a region to which it is necessary to make correction for the trailing end (the trailing end correction region) based on an inflection point of the data (122 Pass as shown in FIG. 4).

5. Calculate averages of 17 Pass accumulative values in 1 to 121 Pass and in 122 to 166 Pass, respectively, and obtain the difference between them.

6. Convert to $1/5760$ inch unit (transport resolution).

Here, it is assumed that a standard transport amount (in.) is $43/720$=1516.9 (μm). In addition, in the above-described first embodiment, it is assumed that accumulation of the transport amounts is 18 Pass accumulation, the transport resolution is $1/4320$ inch, one step=5.9 (μm), the standard transport amount is $41/720$ (that is substantially equal to 1.4 (mm)) and the trailing end correction region is a region from 141 to 170 Pass. However, in the second embodiment, it is assumed that accumulation of the transport amounts is 17 Pass accumulation, the transport resolution is $1/5760$ inch, one step=4.4 (μm), the standard transport amount is $43/720$ (that is substantially equal to 1516.9 (μm), about 1.5 (mm)) and the trailing end correction region is a region from 122 to 166 Pass. This difference depends on a model difference of the paper transport device 110.

⌈41⌋ and ⌈43⌋ used in the above calculation of the standard transport amount are selected such that periodic unevenness and grained texture do not occur in image (image quality) in the basis of head resolution of the recording head and development evaluation. ⌈720⌋ is a standard value of Seiko Epson Corporation. Since nozzle pitches of the recording heads are 90 dpi, 120 dpi and 180 dpi, denominators are 360, 720 and 1440. These values are the standard values.

The steps will be described more specifically.

According to the first step, the raw data that are the pitch data are captured as shown in (A), the second line and the third line from left side in FIGS. 5 to 8.

Next, according to the second step, the differences between the raw data (A) captured in the first step and the standard transport amount that is 1516.9 (μm) are obtained as shown in (B), the fourth line and the fifth line from left side in FIGS. 5 to 8.

According to the third step, the differences are accumulated by 17 Pass as shown in (C), the sixth line and the seventh line from left side in FIGS. 5 to 8. For example, the accumulative value of the first line at the first Pass is obtained by summing differences between the raw data and the transport logical values of 1 to 17 Pass.

According to the fourth step, the region to which it is necessary to make correction for the trailing end is determined as a region from 122 Pass that is an inflection point of the data to 166 Pass in which the trailing end of the paper is released from being nipped between the transport roller pair, in the basis of the raw data (A) shown in FIGS. 4 to 8.

Further, according to the fifth step, 3.1 (μm) is obtained by calculating the average of the 17 Pass accumulative values in 1 to 121 Pass, and 26.0 (μm) is obtained by calculating the average of the 17 Pass accumulative values in 122 to 166 Pass. Then, the difference between the average of the 17 Pass accumulative values in 1 to 121 Pass and the average of the 17 Pass accumulative values in 122 to 166 Pass is obtained as shown in the following equation.

$$3.1\ (\mu m)-26.0\ (\mu m)=-22.9\ (\mu m)$$

According to the sixth step, the value is converted to $1/5760$ inch unit.

$$-22.9\ (\mu m)/25.4\times 5760/1000=-5.2$$

Therefore, the correction of $-5/5760$ inch per 1 inch is made to the region from 122 to 161 Pass. Actually, the correction of ⌈−1⌋ is made to one inch transport that is substantially equal to 17 Pass, five times in a divided manner. Specifically, since 17 divided by 5 is 3.4, the correction is performed in 4, 7, 11, 14 and 17 Pass that are integral number Pass obtained by approximating multiple numbers of the value.

Figure 9:
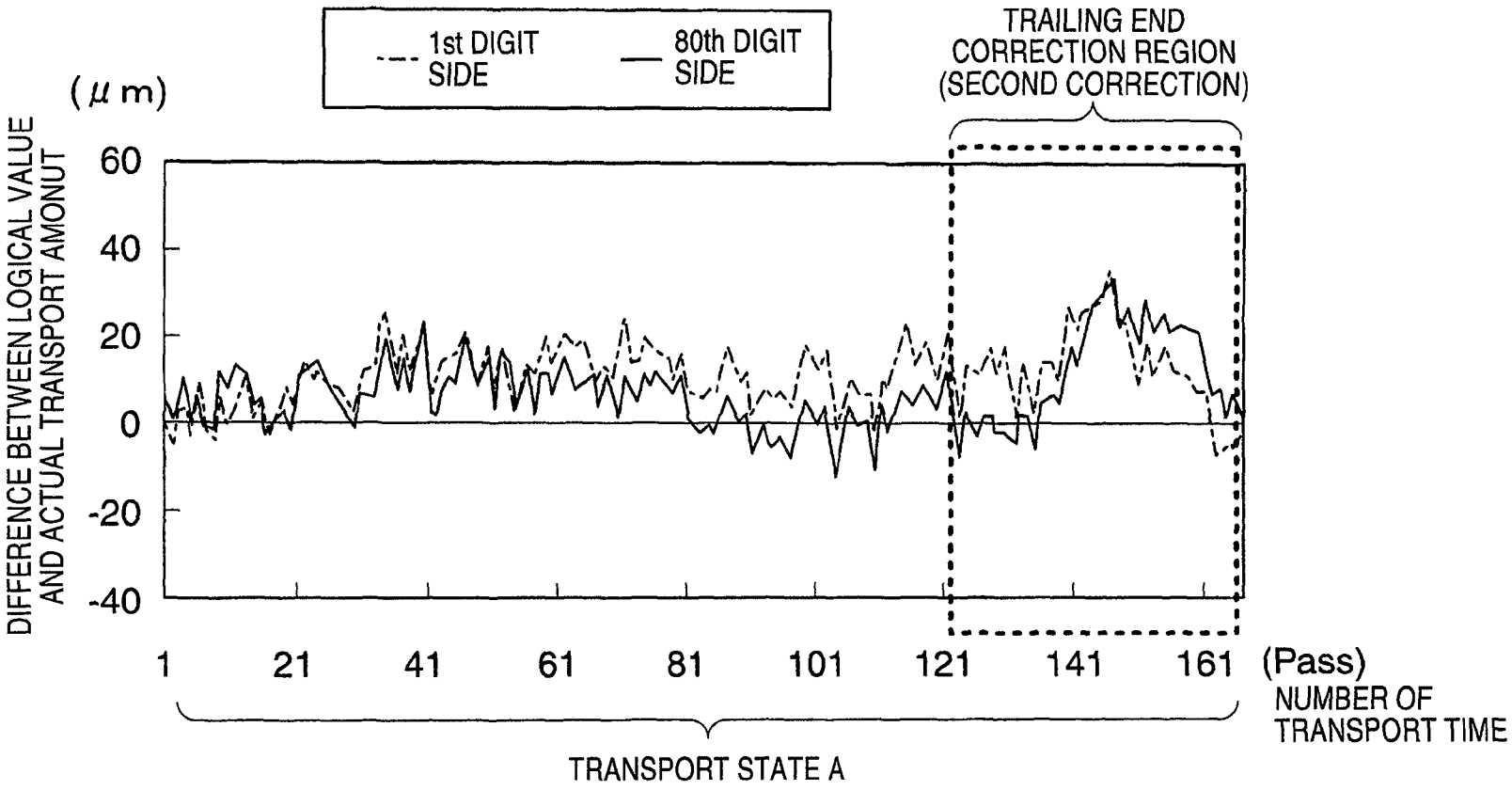
FIG. 9 is a graph illustrating a transport error after correction is performed in the second embodiment.

FIG. 9 shows a graph illustrating a transport error after the trailing end correction (corresponding to the second correction described in the first embodiment) is performed. The longitudinal axis indicates 17 Pass accumulative value of the difference between the logical value and the actual transport amount, and the horizontal axis indicates the number of transport times. FIGS. 10 to 13 show diagrams illustrating data of a transport error after the correction is performed. FIG. 10 shows a divided data from 1 Pass to 50 Pass, FIG. 11 shows a divided data from 51 Pass to 100 Pass, FIG. 12 shows a divided data from 101 Pass to 150 Pass and FIG. 13 shows a divided data from 151 Pass to 193 Pass.

How to obtain the 17 Pass accumulative value is described as the above.

The paper transport device 110 from which the data shown in FIGS. 9 to 13 are collected is the same as the paper transport device 110 from which the data shown in FIGS. 4 to 8 are collected, they are different from each other in a point whether or not the trailing end correction is performed.

As shown in FIGS. 9 to 13, the trailing end correction is performed, thereby making the level of the transport amount in 122 to 161 Pass that corresponds to data region before the trailing end of the paper passes through the transport roller pair 131, approximate to the logical value.

Further, the invention is not limited to the above-mentioned embodiments, and various changes and modifications can be made without departing from the spirit and scope of the invention described in the appended claims. It is needless to say that the modifications and changes are included within a range of the invention.

What is claimed is:

1. A method of controlling transport amounts of a pair of first rollers and a pair of second rollers, the pair of first rollers operable to nip a medium so as to transport the medium in a transport direction, the pair of second rollers operable to nip the medium so as to transport the medium and disposed at a downstream side of the pair of first rollers in the transport direction, the medium on which a recording is performed by a recording head disposed between the pair of first rollers and the pair of second rollers, the method comprising:

performing a first correction with respect to the transport amounts of the pair of first rollers and the pair of second rollers; and performing a second correction with respect to the transport amounts of the medium from a state where a rolling angle of the medium to one of the pair of first rollers starts to vary to a state where the medium is released from the pair of first rollers, wherein an amount of the second correction is set in accordance with a kind of the medium, and, wherein the rolling angle varies according to passing of the medium through a transport pass which the medium is transported on, the transport pass including inclined surfaces having different angles with respect to a horizontal.

2. A transport device, comprising:

a pair of first rollers operable to nip a medium so as to transport the medium in a transport direction;

a pair of second rollers operable to nip the medium so as to transport the medium, and disposed at a downstream side of the pair of first rollers in the transport direction;

a first controller, operable to perform a first correction with respect to transport amounts of the pair of first rollers and the pair of second rollers; and a second controller, operable to perform a second correction with respect to the transport amounts of the medium from a state where a rolling angle of the medium to one of the pair of first rollers starts to vary to a state where the medium is released from the pair of first rollers, wherein an amount of the second correction is set in accordance with a kind of the medium, and wherein the rolling angle varies according to passing of the medium through a transport pass which the medium is transported on, the transport pass including inclined surfaces having different angles with respect to a horizontal.

3. A method of controlling transport amounts of a pair of first rollers and a pair of second rollers, the pair of first rollers operable to nip a medium so as to transport the medium in a transport direction, the pair of second rollers operable to nip the medium so as to transport the medium and disposed at a downstream side of the pair of first rollers in the transport direction, the medium on which a recording is performed by a recording head disposed between the pair of first rollers and the pair of second rollers, the method comprising:

performing a first correction with respect to the transport amounts of the pair of first rollers and the pair of second rollers; and performing a second correction with respect to the transport amounts of the medium from a state where a contact area of the medium with respect to one of the pair of first rollers due to deformation of the medium starts to vary to a state where the medium is released from the pair of first rollers, wherein an amount of the second correction is set in accordance with a kind of the medium, and wherein the contact area varies according to passing of the medium through a transport pass which the medium is transported on, the transport pass including inclined surfaces having different angles with respect to a horizontal.

4. A transport device, comprising:

a pair of first rollers operable to nip a medium so as to transport the medium in a transport direction;

a pair of second rollers operable to nip the medium so as to transport the medium, and disposed at a downstream side of the pair of first rollers in the transport direction;

a first controller, operable to perform a first correction with respect to transport amounts of the pair of first rollers and the pair of second rollers; and a second controller, operable to perform a second correction with respect to the transport amounts of the medium from a state where a contact area of the medium with respect to one of the pair of first rollers due to deformation of the medium starts to vary to a state where the medium is released from the pair of first rollers, wherein an amount of the second correction is set in accordance with a kind of the medium, and wherein the contact area varies according to passing of the medium through a transport pass which the medium is transported on, the transport pass including inclined surfaces having different angles with respect to a horizontal.

* * * * *